US007783242B2

(12) United States Patent
Chigono et al.

(10) Patent No.: US 7,783,242 B2
(45) Date of Patent: Aug. 24, 2010

(54) IMAGE FORMING APPARATUS

(75) Inventors: Yasunori Chigono, Susono (JP); Makoto Fukatsu, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 752 days.

(21) Appl. No.: 11/672,665

(22) Filed: Feb. 8, 2007

(65) Prior Publication Data

US 2007/0147917 A1 Jun. 28, 2007

Related U.S. Application Data

(63) Continuation of application No. PCT/JP2006/316786, filed on Aug. 21, 2006.

(30) Foreign Application Priority Data

Aug. 22, 2005 (JP) ..... 2005-239771
Aug. 9, 2006 (JP) ..... 2006-216793

(51) Int. Cl.
*G03G 15/00* (2006.01)
*G03G 15/20* (2006.01)

(52) U.S. Cl. ..... 399/341; 399/45; 399/67; 399/322; 399/328

(58) Field of Classification Search ..... 399/67, 399/68, 69, 82, 341, 411; 430/124.13
See application file for complete search history.

(56) References Cited

U.S. PATENT DOCUMENTS 4,973,824 A * 11/1990 Ohashi et al. ..... 219/216
5,085,962 A * 2/1992 Aslam et al. ..... 430/124.13
6,512,914 B2 * 1/2003 Kabashima ..... 399/341
6,567,640 B2 5/2003 Ishikawa et al.
6,615,018 B2 * 9/2003 Funato ..... 399/322
6,618,573 B2 9/2003 Ishikawa et al.

(Continued)

FOREIGN PATENT DOCUMENTS

JP 6-230602 8/1994

(Continued)

OTHER PUBLICATIONS

International Preliminary Report on Patentability in International Application No. PCT/JP2006/316786, dated Mar. 6, 2008 (with translation).

*Primary Examiner*—David M Gray
*Assistant Examiner*—Francis Gray
(74) *Attorney, Agent, or Firm*—Fitzpatrick, Cella, Harper & Scinto

(57) ABSTRACT

An image forming apparatus has a first recording mode of outputting the recording material without passing thru the glossiness applying device after fixing and a second recording mode using the glossiness applying device, and then outputting the recording material. In the latter recording mode (B), when a void ratio G of toner in the toner image not yet subjected to the glossing process by the glossiness applying device is defined by a thickness t1 of a toner layer on the recording material after fixing and before entering the glossiness applying device, and a thickness t2 of a toner layer on the recording material after passing through the glossiness applying device, satisfies the formula: G=100×(t1-t2)/t1. In the recording mode (B), fixing conditions for the fixing device and the glossiness applying device are respectively set so that the void ratio of toner satisfies a formula 15≦G≦60.

5 Claims, 8 Drawing Sheets

U.S. PATENT DOCUMENTS

| | | | | |
|---|---|---|---|---|
| 6,771,926 | B2 | 8/2004 | Ishikawa et al. | |
| 6,795,661 | B2 | 9/2004 | Kanesawa et al. | |
| 6,920,304 | B2 | 7/2005 | Kanesawa et al. | |
| 7,206,541 | B2 | 4/2007 | Fukita et al. | 399/328 |
| 7,263,303 | B2 * | 8/2007 | Nakayama | 399/68 |
| 2003/0180063 | A1 * | 9/2003 | Kanesawa et al. | 399/69 |
| 2005/0031361 | A1 * | 2/2005 | Kobayashi | 399/49 |

FOREIGN PATENT DOCUMENTS

| | | |
|---|---|---|
| JP | 9-171323 | 6/1997 |
| JP | 2001-056616 | 2/2001 |
| JP | 2002-091212 | 3/2002 |
| JP | 2002-099159 | 4/2002 |
| JP | 2003-270991 | 9/2003 |
| JP | 2003-316192 | 11/2003 |
| JP | 2004-205563 | 7/2004 |
| JP | 2005-165184 | 6/2005 |
| JP | 2005-173259 | 6/2005 |

* cited by examiner

BEFORE FIXING

AFTER FIXING
(IDEAL CONDITION)

INSUFFICIENT HEATING

EXCESSIVE HEATING

BEFORE FIXING
UNFIXED TONER
P2
P2a
P2b

AFTER PRIMARY FIXING
T
t1

64
S
N2

AFTER SECONDARY FIXING
S1
t2
EMBODIMENT 3

COMPARATIVE EXAMPLE 1

IMAGE FORMING APPARATUS

This application is a continuation of International Application No. PCT/JP2006/316786, filed Aug. 21, 2006, which claims the benefit of Japanese Patent Application Nos. 2005-239771, filed Aug. 22, 2005 and 2006-216793, filed Aug. 9, 2006.

BACKGROUND OF THE INVENTION

1. Field of the Invention

The present invention relates to an image forming apparatus capable of obtaining a toner image excellent in glossiness.

2. Description of the Related Art

Up to now, widely known is an image forming apparatus employing an electrophotographic process such as a copying machine, a printer, a facsimile machine, and a combined machine having functions thereof. In addition, a large number of image forming apparatuses for performing not only a monochromatic image formation but also a full-color image formation are commercially available.

Further, with an increase in use of the image forming apparatuses employing the electrophotographic process in various fields, demands for higher image quality have increased. Herein, one of the factors that determines an image quality, particularly, glossiness of a full-color image is smoothness of an output image.

To meet such the demands, there has been proposed an image forming method for forming a color image in which color toner composed of a thermoplastic resin is transferred onto a recording material (i.e., glossy dedicated paper) having a transparent resin layer composed of the thermoplastic resin, and is heated and melted. As a fixing device preferably used in carrying out the image forming method, there is a belt fixing device. The belt fixing device has a structure in which a recording material bearing a toner image is pressed and heated by a fixing belt formed of a heat-proof belt, the toner image is cooled to be solidified in a state where the recording material is brought into contact with the fixing belt, and the recording material having the toner image fixed thereon is detached from the fixing belt. When such the belt fixing device is used, the toner image is embedded in the transparent resin layer of the recording material. Thus, the entire surface of the recording material becomes smooth, so it is possible to obtain a color image excellent in glossiness.

Such the image forming method has a problem with how to obtain a surface of the recording material having toner formed thereon with smoothness and without a boundary between the toner and the surface of the recording material. JP 2002-091212 A describes that a defect in smoothness at a boundary between images is improved by optimizing a hardness of a belt, thereby making it possible to obtain a smoother recording surface. In addition, JP 2004-205563 A describes that a blistering of a resin layer of the recording sheet is prevented and a rugged appearance (i.e., bump α shown in FIG. 4) of a toner image formed on a recording sheet is eliminated by regulating a fixing temperature of the belt fixing device within a certain constant range according to a softening temperature of the resin layer of the recording sheet.

As described above, even when the glossy dedicated paper having the resin layer provided thereon and the belt fixing device are used, it is difficult to completely eliminate the defect in glossiness due to the bump α of the toner. In particular, it is difficult to eliminate the defect in glossiness due to a dimple S1 (shown in FIG. 4D) which is generated by an effect of the bump of the toner image obtained before the toner image is fixed by the belt fixing device.

To be specific, in FIG. 5C is a schematic cross-sectional view showing a state of a recording material bearing a toner image immediately before entering a fixing nip portion N2 of the belt fixing device. A space denoted by symbol S is blocked by the recording material and the belt on four sides thereof. In other words, a lower portion of the space S is blocked by a resin layer P2*a* of a recording material P, an upper portion of the space S is blocked by a fixing belt 64, an upstream of the space S in a moving direction of the recording material is blocked by a toner layer T, and a downstream of the space S in the moving direction of the recording material is blocked by a fixing nip portion N2, respectively. Thus, the resin layer P2*a* cannot be brought into close contact with a surface of the fixing belt 64. With the presence of the space S, on the surface of the recording material after being fixed with the toner image by the belt fixing device, the dimple S1 shown in FIG. 5D is generated.

To suppress generation of such the dimple S1, it is sufficient to narrow the space S. As described above, in order to narrow the space S, improvements such as selection of the belt with an optimum hardness, and optimization of a heat deformation quantity of the resin layer of a recording sheet have been promoted. However, it is difficult to suppress the effect of the space S.

SUMMARY OF THE INVENTION

Therefore, the present invention has been made in view of the above-mentioned technical problems. An object of the present invention is to provide an image forming apparatus capable of obtaining a high-quality toner image excellent in glossiness.

In order to solve the above-mentioned problems, the present invention provides an image forming apparatus, including: an image forming portion for forming a toner image on a recording material; a fixing device for performing a heating process on the toner image formed on the recording material in the image forming portion; and a glossiness applying device provided to a downstream side of the fixing device in a moving direction of the recording material and including an endless belt contacted with the toner image formed on the recording material, and a pressure roller forming a nip portion for pinching the recording material by being in contact with an outer peripheral surface of the endless belt, for performing a heating process on the toner image formed on the recording material and then cooling the toner image in a state where the recording material is brought into contact with the endless belt, the image forming apparatus having: a first recording mode in which the recording material is outputted without being subjected to a glossing process by the glossiness applying device after the toner image is subjected to the heating process by the fixing device; and a second recording mode in which the glossing process is performed on the toner image by the glossiness applying device after the toner image is subjected to the heating process by the fixing device, and then the recording material is outputted. In the image forming apparatus, in a case where a void ratio G of toner in the toner image formed on the recording material, which has been subjected to the heating process by the fixing device and has not been subjected to the glossing process by the glossiness applying device yet, is defined by a thickness t1 (μm) of a toner layer formed on the recording material before entering the glossiness applying device passing through the fixing device, and a thickness t2 (μm) of a toner layer formed on the recording material after passing through the glossiness applying device, as follows:

$$G=100*(t1-t2)/t1,$$

in the second recording mode, the fixing device and the glossiness applying device are respectively set so that the void ratio G(%) of toner satisfies a formula $15 \leqq G \leqq 60$.

According to the present invention, it is possible to obtain a high-quality toner image excellent in glossiness.

Further features of the present invention will become apparent from the following description of exemplary embodiments with reference to the attached drawings.

DESCRIPTION OF THE EMBODIMENTS

Figure 1:
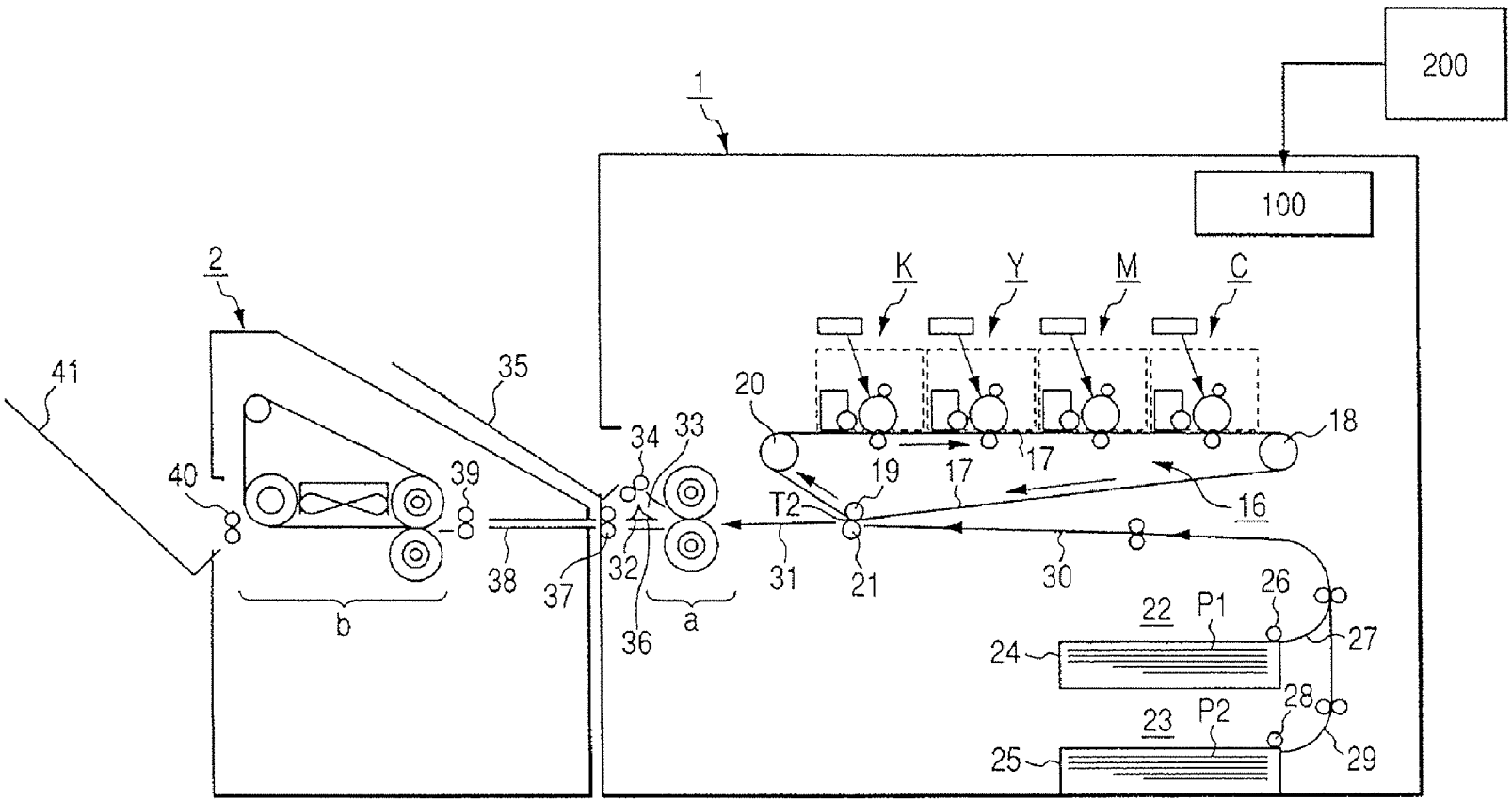
FIG. 1 is a schematic structural view of an image forming apparatus according a first embodiment mode of the present invention.

First Embodiment Mode (1) Overall General Description as to an Example of an Image Forming Apparatus FIG. 1 is a schematic structural view of an image forming apparatus according a first embodiment mode of the present invention. The image forming apparatus includes an image forming apparatus main body (hereinafter, referred to as "apparatus main body") 1 and a belt fixing device unit (i.e., glossiness applying device) 2. The belt fixing device unit 2 is connected on an outlet side of the apparatus main body 1. In this embodiment, the belt fixing device unit 2 is an optional apparatus as a housing separated from the apparatus main body 1, and is capable of outputting an image onto glossy dedicated paper such as a photograph and various types of sheets.

The apparatus main body 1 is an electrophotographic four-color full-color image forming apparatus (i.e., tandem color recording apparatus). An external host apparatus 200 such as a color image reading apparatus or a personal computer is connected to the apparatus main body 1. Various information signals such as image data are inputted from the host apparatus 200 to a control portion (i.e., CPU) 100 of the apparatus main body 1. The control portion 100 carries out an image forming sequence control in response to the various information signals inputted from the host apparatus 200.

The apparatus main body 1 includes four image forming portions (i.e., color stations; image forming means), that is, a first image forming portion K, a second image forming portion Y, a third image forming portion M, and a fourth image forming portion C which are arranged within the apparatus in tandem from left to right of FIG. 1. The apparatus main body 1 also includes an intermediate transfer belt mechanism portion 16 on a lower side of the four image forming portions.

Figure 2:
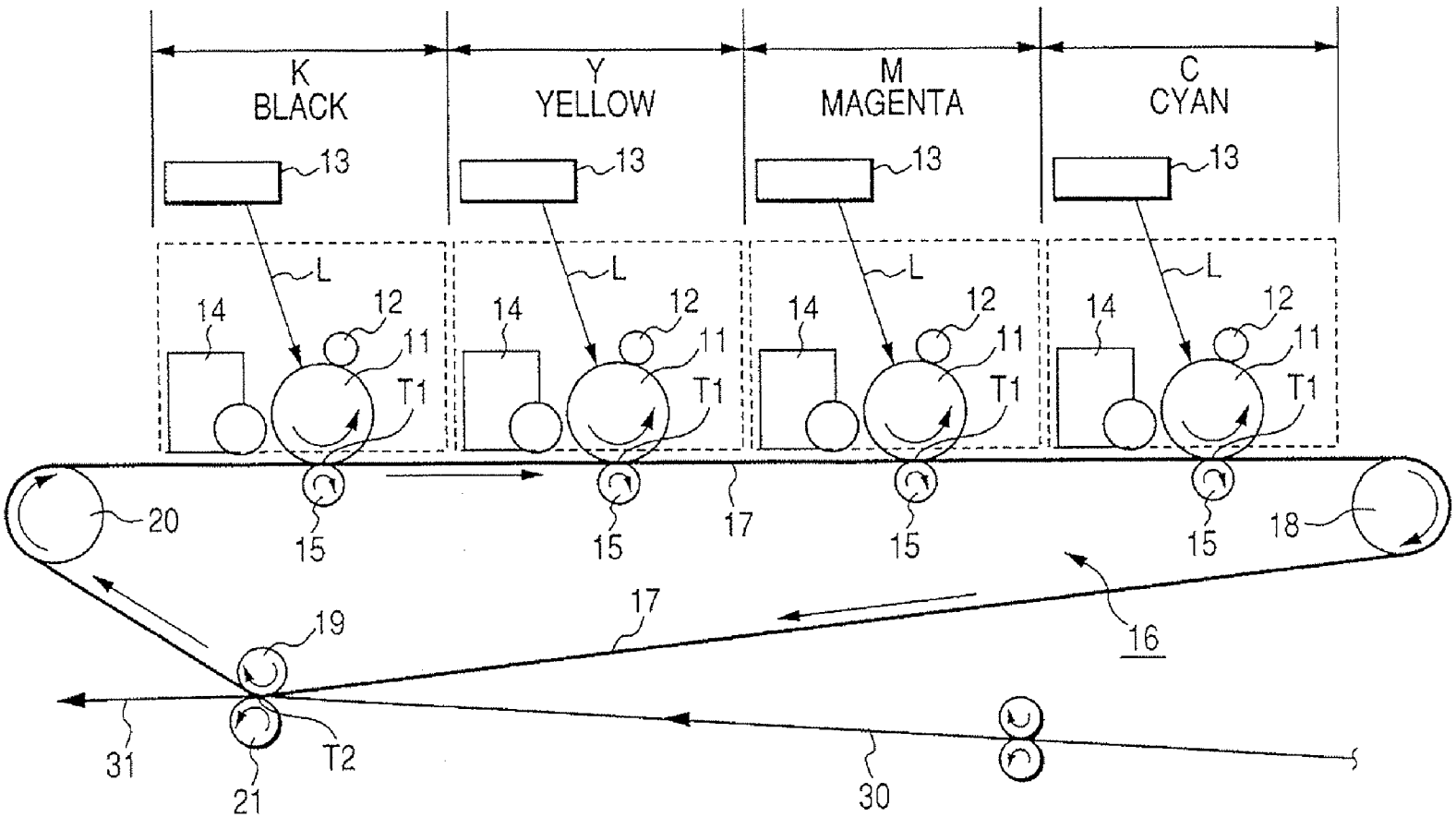
FIG. 2 is an enlarged schematic view showing each of image forming portions and an intermediate transfer belt mechanism portion.
Figure 3:
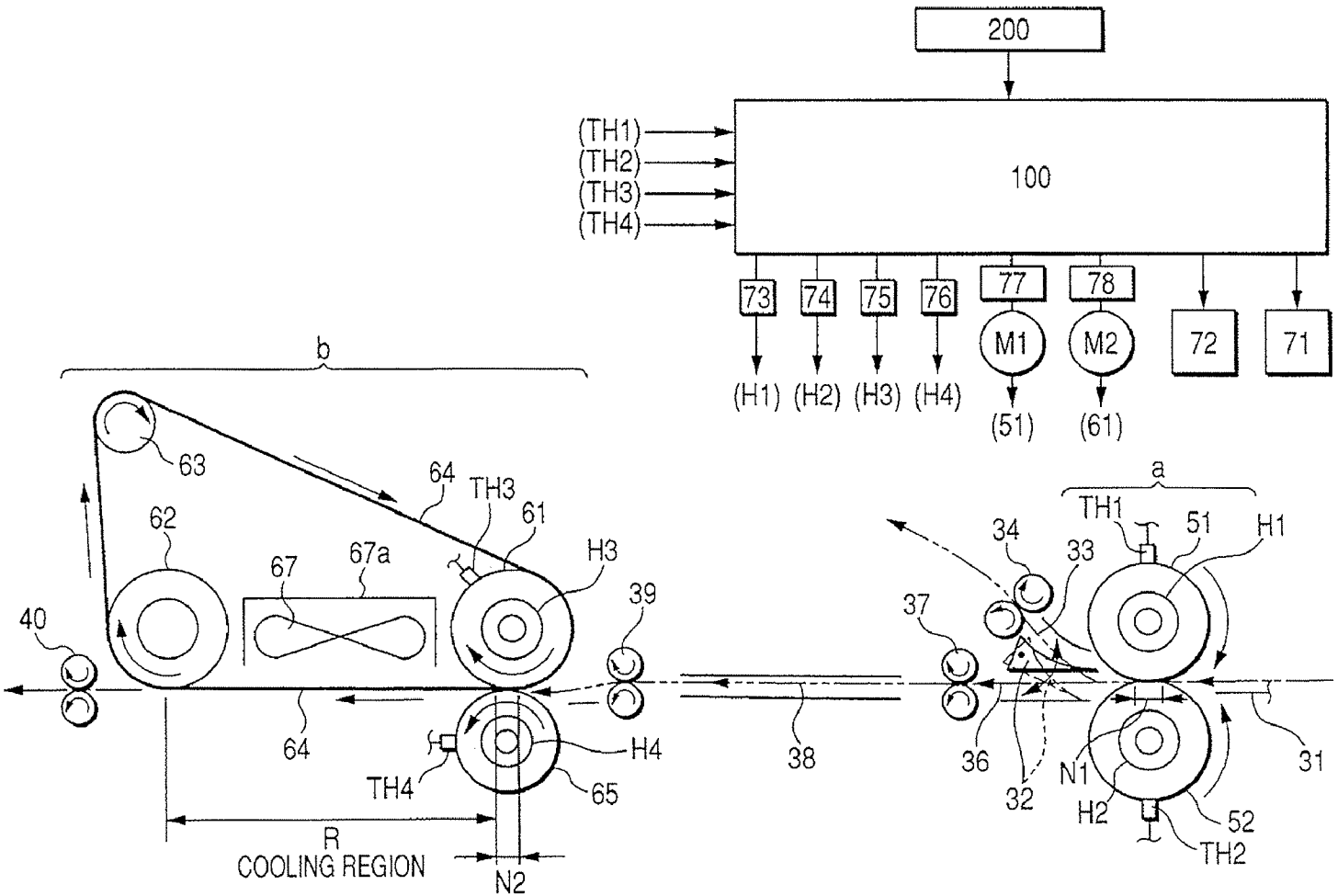
FIG. 3 is an enlarged schematic view showing each of a first fixing device and a second fixing device.

FIG. 2 is an enlarged schematic view showing each of the above-mentioned image forming portions K, Y, M, and C and the intermediate transfer belt mechanism portion 16. FIG. 3 is an enlarged schematic view showing each of a first fixing device (i.e., fixing device) a provided on a side of the apparatus main body 1 and a second fixing device (i.e., glossiness applying device) b provided on a side of the belt fixing device unit 2.

The image forming portions K, Y, M, and C each basically have the same mechanism by the electrophotographic process and each include electrophotographic process devices such as:

1) an electrophotographic photosensitive member (hereinafter, referred to as "drum") 11 of a drum type serving as an image bearing member which is rotationally driven by drive means (not shown) in a counterclockwise direction indicated by the arrows at a predetermined speed;

2) a primary charger 12 for uniformly charging the surface of the drum with a predetermined polarity and potential.

3) a laser scanner unit 13 serving as an exposure device for subjecting a uniformly charged surface of the drum to an optical image exposure L to form an electrostatic latent image.

4) a developing device 14 for developing the electrostatic latent image formed on the drum as a toner image.

5) a primary transfer device (i.e., primary transfer roller) 15 for forming a primary transfer portion T1 in collaboration with the drum 1 through the intermediate transfer belt.

The first image forming portion K has black toner contained in the developing device 14 as a developer, and forms a black toner image on the drum 11.

The second image forming portion Y has yellow toner contained in the developing device 14 as a developer, and forms an yellow toner image on the drum 11.

The third image forming portion M has magenta toner contained in the developing device 14 as a developer, and forms a magenta toner image on the drum 11.

The fourth image forming portion C has cyan toner contained in the developing device 14 as a developer, and forms a cyan toner image on the drum 11.

A formation principle and process itself of the toner image formed with the electrophotographic mechanism is well-known, so descriptions thereof are omitted.

The intermediate transfer belt mechanism portion 16 includes an endless intermediate transfer belt (hereinafter, referred to as "belt") 17 having flexibility, a drive roller 18, a secondary transfer opposing roller 19, a tension roller 20, and a secondary transfer roller 21. The belt 17 is suspended around the drive roller 18, the secondary transfer opposing roller 19, and the tension roller 20 under tension. An ascending side of the belt 17 between the tension roller 20 and the drive roller 18 is arranged between the primary rollers 15 and lower surfaces of the drums of the respective image forming portions. By rotational drive of the drive roller 18, the belt 17 is rotationally driven at substantially the same speed as the rotational speed of the drum 11 in the clockwise direction indicated by the arrows.

The primary transfer rollers 15 of the respective image forming portions are each arranged on a rear side (i.e., inner surface side) of the belt 17, and are abutted against the lower surface of the corresponding drum 11 through the belt 17. As a result, the transfer nip portion T1 is formed between the drum 11 and the surface side (i.e., outer surface side) of the belt 17.

The secondary transfer roller 21 is abutted against the secondary transfer opposing roller 19 through the belt 17. As a result, a secondary transfer nip portion T2 is formed between the secondary transfer roller 21 and the surface of the belt 17.

A full-color image forming operation is described as follows. The first image forming portion K, the second image forming portion Y, the third image forming portion M, and the fourth image forming portion C are sequentially driven in a timing for each image formation. The belt 17 is also rotationally driven. Then, color toner images corresponding to a black component image, an yellow component image, a magenta component image, and a cyan component image of the full-color image are respectively formed on each drum surface of the respective image forming portions at a predetermined control timing. After that, the respective color toner images are sequentially superimposingly transferred onto the surface of the belt 17 in a state of being registered in the primary transfer nip portion T1. As a result, an unfixed full-color toner image is formed and synthesized on the belt 17.

Residual toner on the drums 11 in the respective image forming portions remained after the primary transfer is removed by a cleaner (not shown). Alternatively, the residual toner is removed by cleaning simultaneously with developing.

The unfixed full-color images which have been formed and synthesized on the belt 17 is transported through continuous rotation of the belt 17 and reaches the secondary transfer nip portion T2. Then, the unfixed full-color toner images are collectively transferred onto a recording material (i.e., recording sheet) P1 or P2 which is separately fed from a first feeding apparatus 22 or a second feeding apparatus 23 one by one and is introduced at a predetermined control timing. The toner remained on the belt 17 after the secondary transfer is removed by a cleaner (not shown).

Plain paper is stacked and contained in a feed cassette 24 of the first feeding apparatus 22 as the recording material P1. Glossy dedicated paper is stacked and contained in a feed cassette 25 of the second feeding apparatus 23 as the recording material P2.

Herein, in this embodiment, plain paper having a basic weight of 81 g was used as the recording material P1. Glossy dedicated paper having a resin layer and a basic weight of 220 g was used as the recording material P2.

The recording material P2 which is the glossy dedicated paper has a substrate having a pigment coating layer, which is mainly composed of an adhesive and a pigment, formed on at least one surface thereof, and a resin layer, which is mainly composed of a thermoplastic resin, provided on the pigment coating layer. As the thermoplastic rein, a polyester resin, a styrene-acrylic ester, styrene-methacrylic ester, or the like can be used. In particular, the polyester resin is preferably used. In this embodiment, used as recording material P2 was glossy dedicated paper having a base weight of 220 g in which pigment coating is performed on front and back surfaces of a base material sheet having a weight of 200 g, and one surface thereof is coated with a polyester resin with a thickness of 15 μm.

In a case where a plain paper recording mode (hereinafter, referred to as "recording mode A" or "first recording mode") of carrying out image formation using plain paper is designated, the control portion 100 drives a feed roller 26 of the first feeding apparatus 22 to separately feed the recording material P1 which is plain paper one by one from the feed cassette 24. Then, the control portion 100 transports the recording material P1 on transport paths 27 and 30 and guides the recording material P1 to the secondary transfer nip portion T2 at a predetermined control timing.

In a case where a photograph mode (hereinafter, referred to as "recording mode B" or "second recording mode") of carrying out image formation using glossy dedicated paper having a resin layer formed on a surface thereof is designated, the control portion 100 drives a feed roller 28 of the second feeding apparatus 25 to separately feed the recording material P2 which is glossy dedicated paper one by one from the feed cassette 25. Then, the control portion 100 transports the recording material P2 on transport paths 29 and 30 and guides the recording material P1 to the secondary transfer nip portion T2 at a predetermined control timing.

The recording material P1 or P2 which has passed through the secondary transfer nip portion T2 is separated from the surface of the belt 17 by self stripping, and is guided into the first fixing device a, which is provided in the apparatus main body 1, on a transport path 31. The first fixing device a is a heat roller fixing device to be described later.

In a case where the recording mode A is designated, the control portion 100 controls the first fixing device a on a predetermined fixing condition for the recording mode A. The fixing condition for the recording mode A is a fixing condition in which the unfixed full-color toner image formed on the recording material P1 is subjected to sufficient heat melting and color mixing to be fixed on the recording material P1 as described later. Further, the control portion 100 controls a flapper switching mechanism 71 shown in FIG. 3 to hold a flapper (i.e., transport path switching means) 32, which is arranged on a downstream side of the first fixing device a in the transport direction of the recording material, in a first posture represented by the alternate long and two short dashes line of FIG. 3. Thus, the recording material P1 having passed through the first fixing device a is guided to an upward transport path 33 side, and is delivered onto a first delivery tray 35, which is provided to the apparatus main body 1 side, by a first delivery roller pair 34 as a full-color image-formed product.

In a case where the recording mode B is designated, the control portion 100 controls the first fixing device a on a predetermined fixing condition for the recording mode B as described later. Further, the control portion 100 controls the flapper switching mechanism 71 to hold the flapper 32 in a second posture represented by the solid line of FIG. 3. Thus, the recording material P2 having passed through the first fixing device a is guided to a straight transport path 36 side, and is introduced into the belt fixing device unit 2 from the apparatus main body 1 side by a second delivery roller pair 37. The recording material P2 guided into the unit 2 is introduced into the belt fixing device, which is the second fixing device b, passing through a transport path 38 and transport rollers 39. Then, the recording material P2 is subjected to secondary fixing (i.e., glossing process), and is delivered onto a second delivery tray 41, which is provided on the unit 2 side, by a third delivery roller pair 40 as the full-color image-formed product excellent in glossiness.

In other words, when the recording mode A is designated, the recording material (i.e., plain paper) P1 bearing the unfixed full-color toner image is sufficiently subjected to the fixing process only by the first fixing device a, and is delivered onto the first delivery tray 35 as the full-color image-formed product. When the recording mode B is designated, the recording material (i.e., glossy dedicated paper) P2 bearing the unfixed full-color toner image is subjected to the fixing process twice, that is, the primary fixing (i.e., temporary fixing; heating process) by the first fixing device a and the second fixing process of the secondary fixing (i.e., permanent fixing; glossing process) by the second fixing device b, and is delivered onto the second delivery tray 41 as the full-color image-formed product excellent in glossiness.

The control of the first fixing device a in the recording mode A and the control of the first fixing device a and the second fixing device b in the recording mode B will be described later.

The image forming apparatus according to this embodiment is also capable of outputting a monochromatic image-formed product. When a monochromatic image forming mode is selected, only the first image forming portion K for forming a black toner image is operated to form an image, and the drums of the other image forming portions are rotationally driven, but the other image forming portions are not operated to form images. Then, the black toner image formed on the drum 11 of the first image forming portion K is primarily transferred onto the belt 17. The toner image is secondarily transferred onto the recording material P1 (when the recording mode A is designated) or the recording material P2 (when the recording mode B is designated) in the secondary transfer nip portion T2. The recording material P1 is sufficiently subjected to the fixing process only by the first fixing device a and is delivered onto the first delivery tray 35 as the monochromatic image-formed product. The recording material P2 is subjected to the fixing process twice, that is, the primary fixing by the first fixing device a and the secondary fixing by the secondary fixing device b, and is delivered onto the second delivery tray 41 as the monochromatic image-formed product excellent in glossiness.

(2) First Fixing Device (i.e., Fixing Device) A

In this embodiment, the first fixing device a is a heat roller fixing device (i.e., oilless fixing device). Referring to FIG. 3, the first fixing device a includes a fixing roller 51 serving as a fixing member and a pressure roller 52 serving as a pressure member. The fixing roller 51 has an elastic layer formed on an outer peripheral surface of a hollow pipe roller made of a metal. In addition, a halogen lamp H1 serving as a heat source is arranged in the hollow pipe roller. The pressure roller 52 also has an elastic layer formed on the outer peripheral surface of the hollow pipe roller made of a metal. Further, a halogen lamp H2 serving as a heat source is arranged in the hollow pipe roller. The above-mentioned fixing roller 51 and the pressure roller 52 are arranged in parallel with each other in the vertical direction, and form the fixing nip portion N1 by being rotationally axially supported and being pressed with each other by a pressure mechanism. The fixing roller 51 is rotationally driven by a drive source M1 in the clockwise direction. The pressure roller 52 rotates by being driven by the rotation of the fixing roller 51.

The control portion 100 controls a driver 77 to rotationally drive the fixing roller 51 by the drive source M1. In addition, the control portion 100 controls power supplying portions 73 and 74 to supply the halogen lamps H1 and H2 with electric power and cause the halogen lamps H1 and H2 to generate heat, thereby heating the fixing roller 51 and the pressure roller 52. Surface temperatures of the fixing roller 51 and the pressure roller 52 are detected by thermistors TH1 and TH2, respectively, and the detected temperature information is inputted to the control portion 100. The control portion 100 controls power supply from the power supplying portions 73 and 74 to the halogen lamps H1 and H2 to control the temperature of the first fixing device a to be a predetermined temperature based on the detected temperature information to be inputted.

The control portion 100 can regulate the fixing speed and the controlled temperature of the first fixing device a by controlling the drive source Ml and the power supplying portions 73 and 74. In addition, the control portion 100 can release the pressure applied between the fixing roller 51 and the pressure roller 52 to switch to and hold a state where the fixing roller 51 and the pressure roller 52 are spaced apart from each other, by controlling the pressure mechanism 72. The control portion 100 controls the separation of the roller 51 from the roller 52 to release the pressure applied between sheet metals (not shown) of the fixing roller 51 and the pressure roller 52 by a cam roller (not shown).

(3) Second Fixing Device (i.e., Glossiness Applying Device) B

The second fixing device b is a belt fixing device capable of outputting an image having a high gloss by heating, cooling, and separation. Referring to FIG. 3, the second fixing device b includes a first fixing roller (hereinafter, referred to as "fixing roller") 61, and a rotation roller (hereinafter, referred to as "separation roller") 62 which is arranged to be spaced apart from the fixing roller 61 by a predetermined distance. In addition, the second fixing device b includes a rotation roller (hereinafter, referred to as "tension roller") 63 arranged on an upper side of the separation roller 62, and an endless fixing belt 64 suspended around three rollers 61, 62, and 63 under tension. Further, the second fixing device b includes a second fixing roller (hereinafter, referred to as pressure roller) 65 which is opposed to and is brought into press-contact with the fixing roller 61 by nipping the fixing belt 64, and a cooling fan 67 arranged between the fixing roller 61 and the separation roller 62 inside the fixing belt 64. The cooling fan 67 cools an area of the fixing belt between the fixing roller 61 and the separation roller 62 as a recording material cooling region R.

A predetermined tensile force is applied to the fixing belt 64 by the tension roller 63 so that the curvature of the fixing belt in the cooling region R is maintained to be a substantially constant curvature by the rigidity of the fixing belt.

The fixing roller 61 is composed of a hollow pipe made of aluminum having a diameter of 60 mm and a thickness of 5 mm. Inside the hollow pipe, there is arranged a halogen lamp H3 serving as a heat source.

The pressure roller 65 employs a three-layered structure in a concentric manner, and has a core portion, an elastic layer, and a release layer. The core portion is composed of a hollow pipe made of aluminum having a diameter of 44 mm, and a thickness of 5 mm. The elastic layer is composed of silicon rubber having a JIS-A hardness of 50 degree, and a thickness of 3 mm. The release layer is composed of tetrafluoroethylene-perfluoroalkylvinylether copolymer (PFA) having a thickness of 50 μm. Inside the hollow pipe of the core portion, there is arranged a halogen lamp H4 serving as a heat source.

The fixing roller 61 and the pressure roller 65 are brought into press-contact with each other by a predetermined pressing force to nip the fixing belt 64, thereby forming the fixing nip portion N2 as the heating/pressure-applying portion with a predetermined width.

The fixing belt 64, in this embodiment, has an elastic layer, a primer layer, and a mirror-like release layer (i.e., smooth surface layer) stacked on a base resin layer (i.e., substrate). The base material is composed of a polyimide resin having a thickness of 100 μm. For the elastic layer, silicone rubber is used. Further, a PFA tube (having a thickness of 30 μm) serving as the release layer is bonded to the silicone rubber through the primer layer, thereby forming the fixing belt 64.

The control portion 100 controls a driver 78 to rotationally drive the fixing roller 61 by the drive source M2 at a predetermined speed. By the rotational drive of the fixing roller 61, the fixing belt 64 rotates in the clockwise direction indicated by the arrows. The separation roller 62, the tension roller 63, and the pressure roller 65 are rotationally driven by the rotation of the fixing belt 64.

Further, the control portion 100 controls power supplying portions 75 and 76 to supply the halogen lamps H3 and H4 with electric power and cause the halogen lamps H3 and H4 to generate heat, thereby heating the fixing roller 61 and the pressure roller 65. Surface temperatures of the fixing roller 61 and the pressure roller 65 are detected by thermistors TH3 and TH4, respectively, and the detected temperature information is inputted to the control portion 100. The control portion 100 controls power supply from the power supplying portions 75 and 76 to the halogen lamps H3 and H4 to control the temperature of the second fixing device b to be a predetermined temperature based on the detected temperature information to be inputted. In other words, the control portion 100 controls the temperature of the fixing nip portion N2 to the predetermined fixing temperature by controlling the temperatures of the fixing roller 61 and the pressure roller 65 to predetermined temperatures.

As described above, in the photograph mode in which glossy dedicated paper P2 having a resin layer provided on a surface thereof is used as the recording material, the recording material P2 subjected to the primary fixing (i.e., temporal fixing) of the toner image by the first fixing device a is introduced into the belt fixing device b serving as the second fixing device to be subjected to the secondary fixing (i.e., permanent fixing).

In other words, the recording material P2 introduced into the belt fixing device b is introduced between the fixing belt 64 and the pressure roller 65 of the fixing nip portion N2 to be nipped and transported. The toner image surface of the recording material P2 which has been subjected to the primary fixing is opposed to the surface of the fixing belt 64. During a process in which the recording material P2 is nipped and transported through the fixing nip portion N2, the toner image having been subjected to the primary fixing is further subjected to sufficient heat melting and color mixing. Temperature of the resin layer on the recording material surface is raised to be high, thereby softening the resin layer. In addition, pressure is applied between the fixing roller 61 and the pressure roller 65, thereby embedding the toner image in the resin layer which has been softened due to high-temperature softening. At the same time, the recording material surface is brought into close contact with the surface of the fixing belt. The recording material P2 is transported through the cooling region R which is between the fixing nip portion N2 and the separation roller 62 by the rotation of the fixing belt 64 in a state where the recording material P2 is in close contact with the surface of the fixing belt. In the cooling region R, the recording material P2 is forcibly cooled with efficiency through the fixing belt due to operations of the cooling fan 67 and an airflow within an air duct 67*a* surrounding the cooling fun 67. An airflow perpendicular to the surface of the recording material is generated by the cooling fan 67.

The recording material P2 which is in close contact with the surface of the fixing belt 64 is sufficiently cooled in the cooling region R, reaches the position of the separation roller 62, and is detached (i.e., self-stripped) from the surface of the fixing belt 64 by its own rigidity (i.e., stiffness) in a region in which the curvature of the fixing roller 64 is changed by the separation roller 62. At the position of the separation roller 62, the recording material P2 is cooled to the temperature of about 30° C., and is spontaneously separated from the surface of the fixing belt 64 due to the curvature of the separation roller 62. Thus, the toner image having a high gloss was obtained. Then, the toner image is delivered onto the second delivery tray 41 provided on the unit 2 side by the third delivery roller pair 40 as the full-color image-formed product (or monochromatic image-formed product) excellent in glossiness.

To obtain a photo-like image having a high gloss, as described above, it is effective to adopt a process in which the toner image is formed on the recording material P2 (i.e., glossy dedicated paper) and the toner image is embedded in the resin layer of the surface of the recording material P2 by the belt fixing device. Through such the glossing process, the surface of the processed recording material P2 is smoothed, and the glossiness thereof is improved.

Figures 5A, 5B, 5C, 5D, 5E, 5F, 5G:
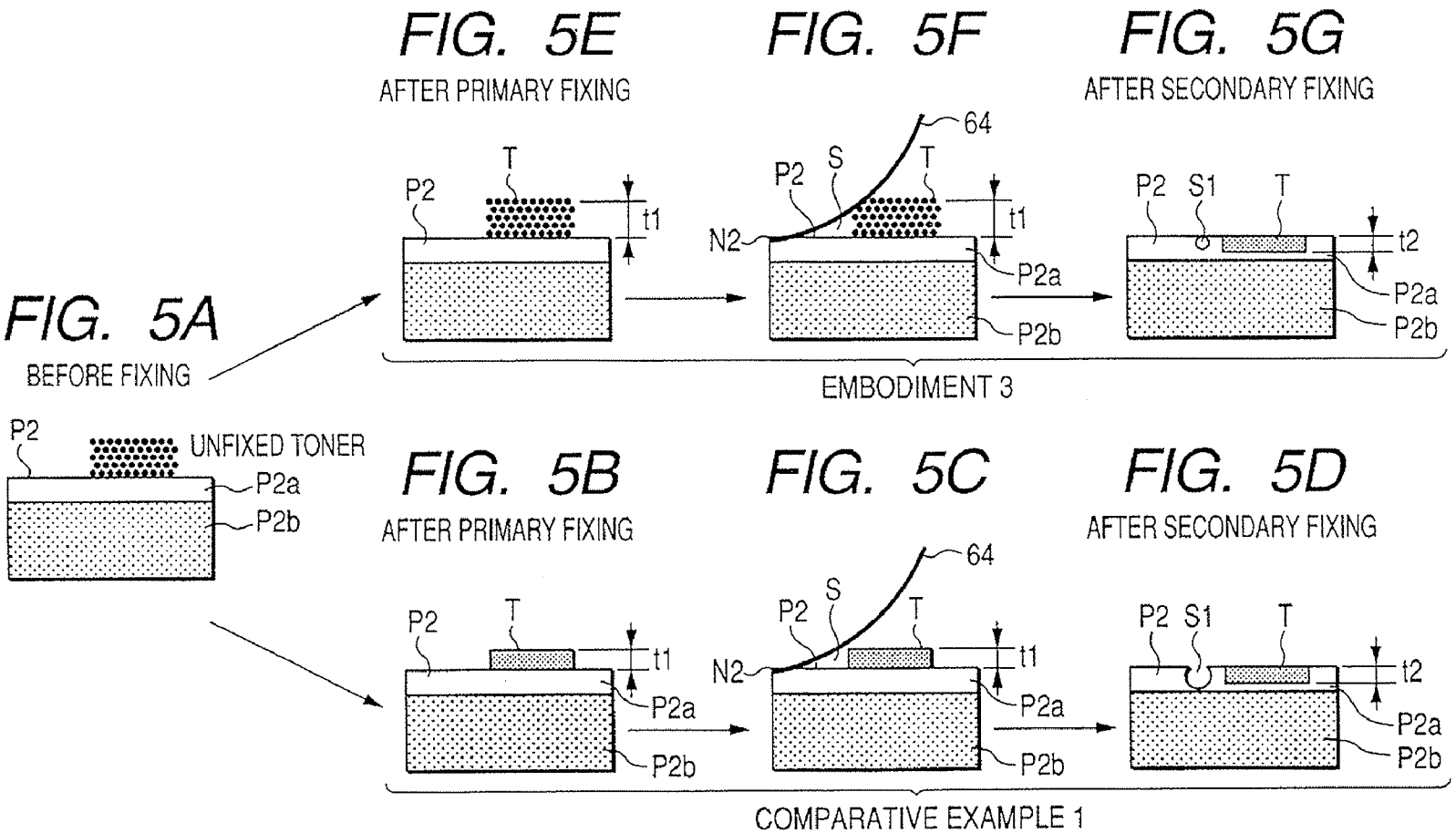
FIGS. 5A, 5B, 5C, 5D, 5E, 5F and 5G are schematic views relating to a state of toner fixed on the recording material according to Embodiment 3 and Comparative Example 1 of the present invention.

However, when the glossing process is performed by the belt fixing device, the dimple S1 shown in FIG. 5D is generated on the surface of the recording material P2 after the glossing process by the belt fixing device due to the presence of the space S shown in FIG. 5C. When the dimple S1 is generated on the surface of the recording material P2, the smoothness of the surface of the recording material P2 is lowered, with the result that the glossiness of an output image is reduced.

I view of the above, the inventors of the present invention reviewed how to decrease the space S which causes generation of the dimple S1. As a result, it has been proved that it is preferable to increase voids in the toner image formed on the recording material P2, which has been subjected to heating process by the first fixing device a and is not yet subjected to the glossing process by the belt fixing device. In other words, it is effective to suppress the heating process by the first fixing device a.

FIGS. 5A to 5G show a flow which represents a difference between a case (i.e., process B1) where the toner image formed on the second recording material P2 is sufficiently melted by the first fixing device a and then is subjected to the glossing process by the second fixing device b, and a case (i.e., process B2) where the toner image formed on the recording material P2 is subjected to the glossing process by the second fixing device b in a state where voids remain in the toner layer by suppressing the heating process by the first fixing device a. A flow represented by FIGS. 5A, 5B, 5C, and 5D in the stated order corresponds to the process B1 (i.e., Comparative Example 1), and a flow represented by FIGS. 5A, 5E, 5F, and 5G in the stated order corresponds to the process B2 (i.e., Embodiment 3). FIG. 5A shows an unfixed state of toner, that is, states of the recording material P2 and the toner before being introduced into the first fixing device a. The toner is present on the recording material P2 as particles, and the thickness thereof in a second color portion (i.e., portion in which two color toners are overlapped) is about 17 μm to 20 μm.

First, in the process B1 represented by FIGS. 5B to 5D, since the toner image is sufficiently heated and applied with pressure by the first fixing device a, the toner is sufficiently melted, which decreases the voids within the toner layer. As a result, as shown in FIG. 5B, the thickness t1 of the toner layer after the primary fixing is decreased to 9.5 μm. In the toner layer after the primary fixing, few grain boundaries of the toner particles are present, and the toner is sufficiently melted and solidified. As shown in FIG. 5C, in front of the fixing nip portion N2 of the second fixing device b, the space S surrounded by the recording material P2, the fixing belt 64, and the toner layer T is present at the boundary of the toner. The space S is surrounded by the resin, so it is impossible to easily remove air from the space S. As a result, as shown in FIG. 5D, the dimple S1 generated due to the space S is present on the surface of the resin layer P2*a* of the recording material P2 after the secondary fixing. A plurality of dimples S1 are present on the surface of a single the recording material P2. As described above, the glossiness of the output image depends on the smoothness of each of the surface of the resin layer P2*a* of the recording material P2 and the surface of the toner image T. Thus, the glossiness of the output image is lowered due to the presence of the dimple S1.

On the other hand, in the process B2 as shown in FIGS. 5E to 5G, as shown in FIG. 5E, the toner layer after passing through the first fixing device a still has a large thickness, and a plurality of voids remain in the toner layer. As shown in FIG. 5F, in the same manner as in the process B1, in front of the fixing nip portion N2 of the second fixing device b, the space S surrounded by the recording material P2, the fixing belt 64, and the toner layer T is generated. However, the voids still remain in the toner layer, so it is possible to gradually remove air from the space S at a time when the toner layer is melted by the second fixing device b. As shown in FIG. 5G, all the air cannot be removed from the space S depending on the state of the toner, but the size of the dimple S1 can be reliably reduced as compared with the process B1 in FIG. 5D. As a result, the glossiness of the output image can be raised as compared with the process B1.

Thus, it has been proved that the remaining amount of the voids of toner particles in the toner layer on the recording material P2 before being introduced into the second fixing device b is closely related to the defect in glossiness. Accordingly, the inventors further made studies on a relationship between the decrease of the size of the dimple S1 and the remaining amount of the voids in the toner layer after the heating process by the first fixing device a.

The inventors decided to measure a difference between the thickness t1 (μm) of the toner layer after the heating process by the first fixing device a and the thickness t2 (μm) of the toner layer after the glossing process by the second fixing device b to obtain a void ratio of the toner layer after the heating process by the first fixing device a. Since only few voids remain in the toner layer after the glossing process by the second fixing device b, a value (t1−t2) obtained by subtracting the thickness t2 (μm) of the toner layer after the glossing process by the second fixing device b from the thickness t1 (μm) of the toner layer after the heating process by the first fixing device a is assumed to be a void amount of the toner layer after the heating process by the first fixing device a.

Then, the void ratio G(%) in the toner layer after the heating process by the first fixing device a is obtained by using the thickness t1 (μm) and the thickness t2 (μm). To be specific, the void ratio is represented as follows:

$$G=100\times(t1-t2)/t1.$$

As described later, the correlation between the void ratio G and the glossiness of the output image was observed by variously changing the fixing conditions of the first fixing device a. As a result, it has been proved that when the formula 15≦G≦60, more preferably, 40≦G≦60 is satisfied, the dimple S1 generated on the surface of the recording material P2 becomes small, and the glossiness becomes higher. Thus, in the recording mode B (i.e., second recording mode), it has been proved that the fixing conditions of the first fixing device a and the second fixing device b are preferably set to satisfy the formula 15≦G≦60, more preferably, 40≦G≦60.

(3) Control of the First Fixing Device A in the Recording Mode A

As described above, when the recording mode A, which is the plain paper recording mode, is designated, the control portion 100 controls, in this embodiment, the first fixing device a to set a process speed to be 130 mm/s, a temperature of the fixing roller to be 190° C., and a temperature of the pressure roller to be 190° C. As a result, the unfixed full-color toner image formed on the recording material P1 is subjected to sufficient heat melting and color mixing, thereby making it possible to fix the toner image on the recording material P1. Alternatively, the unfixed monochromatic toner image formed on the recording material P1 can be subjected to sufficient heat melting and color mixing, thereby making it possible to fix the toner image on the recording material P1. The process speed in this image formation is 130 mm/s.

(4) Controls of the First Fixing Device A and the Second Fixing Device B in the Recording Mode B When the recording mode B, which is the photograph mode, is designated, the control portion 100 controls, in this embodiment, the second fixing device b to set the respective surface temperatures of the fixing roller 61 and the pressure roller 65 to be 170° C., and a fixing speed to be 35 mm/s. In this case, while a speed difference is generated between the first fixing device a and the second fixing device b, the speed of the recording sheet is reduced between the first fixing device a and the second fixing device b, and the recording material is allowed to rush into the second fixing device b at the same speed as that in the second fixing device b.

Assuming that the thickness of the toner layer on the recording material P2, which has been subjected to the primary fixing by the first fixing device a and is not yet introduced into the second fixing device b, is set to t1 (μm), and the thickness of the toner image obtained by introducing the recording material into the second fixing device b and subjected to the secondary fixing is set to t2 (μm), the void ratio G (%) of toner in the toner layer, which has been subjected to the primary fixing and has not yet been introduced into the second fixing device b, is represented as follows:

$$G=100\times(t1-t2)/t1.$$

Herein, in the recording mode B according this embodiment, the fixing condition of the first fixing device a is set in advance to satisfy the formula 15≦G≦60, more preferably, 40≦G≦60. To be specific, the fixing condition of the first fixing device a is preferably set in advance to one of the conditions according the respective embodiments described in the following section (5).

In the embodiments to be described later, the setting of the second fixing device b is fixed as described above, and the setting of the first fixing device a is variously changed to evaluate the glossiness of the image to be outputted. However, the setting of the second fixing device b is not limited to the above-mentioned setting. Alternatively, another setting of the second fixing device b different from the above-mentioned setting may be adopted as long as the formula 15≦G≦60 is satisfied.

Figure 7:
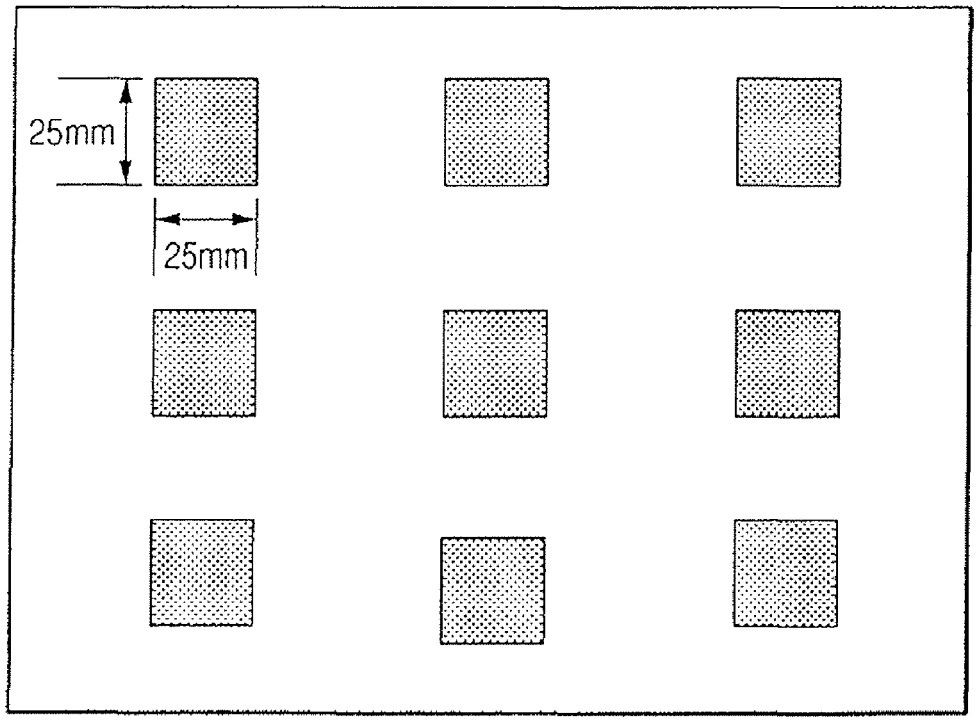
FIG. 7 is a diagram showing test patterns formed on a recording material P2 to obtain thicknesses t1 and t2 of a toner layer formed on a recording material P2.

The above-mentioned void ratio G of toner represents a ratio which is obtained by dividing voids generated among the grain boundaries of the toner particles within the toner layer by a true volume of the toner, and which is expressed as a percentage. The thicknesses t1 and t2 of the toner layer were obtained by measuring the entire thickness of the recording material P2. The thickness of the toner layer was obtained by subtracting a mean value in solid image portions to be described later from a mean value in white base portions. However, with particular regard to the measurement of the toner layer thickness t2 after the secondary fixing, there was a case where the thickness of the toner could not be precisely measured from the entire film thickness. Thus, as the measuring method for the thickness t2, it is preferable to directly measure the thickness t2 by cutting the recording material P2 after the secondary fixing to measure the cut surface with a microscope. In this embodiment, under the condition in which a room temperature is set to 23° C. and humidity is set to 50%, the toner images as shown in FIG. 7 is formed on the recording material P2 to obtain an image sample SA1 after the heating process by the first fixing device a, and an image sample SA2 which has been subjected to the heating process by the first fixing device a and further subjected to the glossing process by the second fixing device b. The toner images formed on the A4-size recording material P2 each have a size of 25 mm in length and width, and 9 solid patch images of the second color (e.g., blue color) are arranged evenly. Patch image portions of the image samples SA1 and SA2 thus obtained are slit. Then, the cut surfaces are slit. The samples are pressed and cut by perpendicularly bringing a commercially-available razor into contact with the image recording surface. Cut surfaces thus obtained are observed using an optical microscope (having an objective from 20 times to 50 times), and a distance between the surface of the toner layer and the boundary surface of the resin layer is measured to be set as the thickness of the toner layer. Measurement is conducted three times for each of the 9 patch images, thereby calculating the mean value from the 27 measurement results in total. Thus, the thickness t1 is calculated from the image sample SA1, and similarly, the thickness t2 is calculated from the image sample SA2.

Next, the fixing condition of the second fixing device b will be described.

Figure 4A:
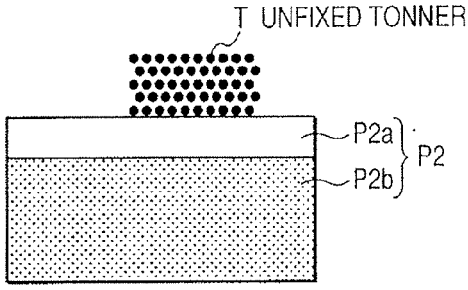
FIGS. 4A, 4B, 4C, 4D and 4E are schematic views showing a state of toner on a recording material.
Figure 4B:
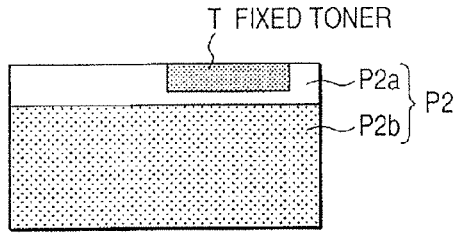
Figure 4C:
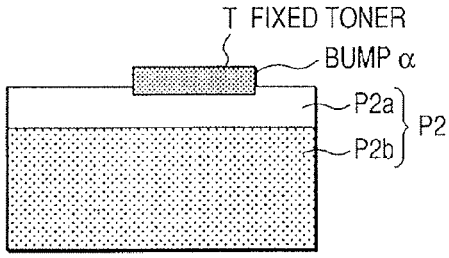

For the first fixing device a, a rubber roller is used as the fixing roller, but the toner image cannot be sufficiently melted, which generates a toner bump α having a height of about 10 μm as shown in FIG. 4C. Therefore, it is not preferable to use only the first fixing device a in view of improving the glossiness of the output image. Thus, selected was the fixing condition in which the bump α of the toner layer is reduced in size by the primary fixing performed by the first fixing device a and the secondary fixing performed by the second fixing device b. To be specific, the unfixed toner image was first formed on the recording material (i.e., glossy dedicated paper) P2 in the apparatus main body 1. In the unfixed toner image, similarly to the image used when the thicknesses t1 and t2 of the toner layer are obtained as shown in FIG. 7, the solid image portion in which toner amount becomes maximum is partially formed on the recording material P2. The recording material P2 having the unfixed toner image formed thereon is not processed by the first fixing device a but is directly processed by the second fixing device b. The process is carried out a plurality of times by variously changing the setting (e.g., temperature and process speed) of the second fixing device b. Then, the setting of when the bump α disappears is determined as the setting of the second fixing device b. One of the settings of the second fixing device b thus determined is the above-mentioned setting in which the respective surface temperatures of the fixing roller 61 and the pressure roller 65 are set to be 170° C., and the fixing speed is set to be 35 mm/s.

From the experimental result, as the setting of the second fixing device b, first, a pressuring time τ3 (s) is set in a range from 0.05 sec to 0.25 sec, more preferably, in a range from 0.1 sec to 0.2 sec. Further, the respective surface temperatures of the fixing roller 61 and the pressure roller 65 are set in a range from 100° C. to 200° C., more preferably, in a range from 130° C. to 170° C.

Herein, the pressuring time τ3 (s) was calculated from the fixing nip width N2 (mm)/process speed (mm/s). The fixing nip width N2 (mm) is obtained in the following manner. That is, the recording material having the recorded image is inserted into the second fixing device b by reversing the surface thereof so that the toner image surface faces the pressure roller 65, the drive of the motor is stopped for about 10 sec during sheet transportation to measure the variation width of the glossiness on the recorded image taken out by driving the motor again, thereby obtaining the fixing nip width N2. From the width N2, the pressuring time τ3 is calculated.

Figure 4D:
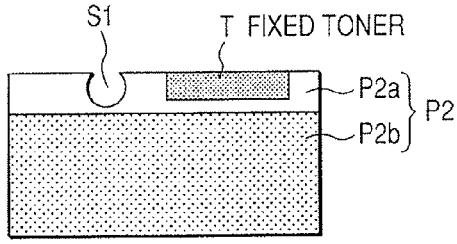
Figure 4E:
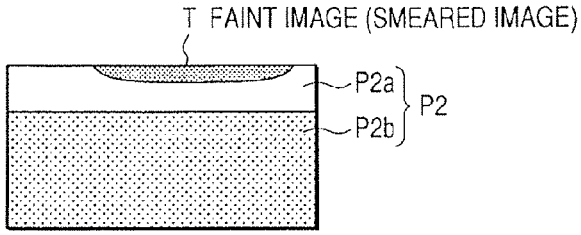

Further, as described with reference to FIGS. 4A to 4E, as in the state before the fixing shown in FIG. 4A, the toner T transferred onto the recording material P2 which is glossy dedicated paper has a height of several to several tens μm in the unfixed state. In this embodiment, by the use of the first fixing device a and the second fixing device b, as shown in FIG. 4B, the toner image is completely melted and smoothed on the rein layer (i.e., transparent resin layer) P2*a*, thereby obtaining the image having a high gloss. Reference symbol P2*b* denotes a substrate of the recording material P2. When the heating is not sufficient, the toner on the surface of the recording material P2 is not sufficiently melted, whereby the bump α remains as shown in FIG. 4C, or the surface of the recording material is not sufficiently melted, whereby irregularities remain on the surface thereof. As a result, there arises a problem in that the high gloss cannot be obtained. When further heating is applied, as shown in FIG. 4D, the rugged appearance of toner disappears, but the defect in glossiness such as the dimple S1 may occur at the boundary between the toner and the resin layer P2*a*. Further, when excessive heating is applied, as shown in FIG. 4E, the toner is excessively melted, thereby forming a faint image (hereinafter, referred to as "smeared image") with a large width.

So as not to raise such the problem, the fixing condition was studied and was regulated to obtain the preferable image.

(5) Embodiments 1 to 5 and Comparative Examples 1 to 3

Embodiments 1 to 5 and Comparative Examples 1 to 3 each relate to image formation in the recording mode B which is the photograph mode using the recording material P2 that is glossy dedicated paper. In the Embodiments 1 to 5 and Comparative Examples 1 to 3, the setting of the second fixing device b is fixed to the above-mentioned setting, and the setting of the first fixing device a is variously changed. The second fixing device b which is the belt fixing device is controlled such that the respective surface temperatures of the fixing roller 61 and the pressure roller 65 are set to 170° C. and the fixing speed is set to 35 mm/s. Thus, only the setting of the first fixing device a varies in each of the embodiments and comparative examples. However, another setting of the second fixing device b different from the above-mentioned setting may be adopted as long as the formula $15 \leqq G \leqq 60$ is satisfied.

Embodiment 1

In this embodiment, the pressing force applied between the fixing roller 51 and the pressure roller 52 of the first fixing device a was released, and the fixing roller 51 and the pressure roller 52 were spaced apart from each other. Then, the recording material P2 bearing the toner image was allowed to pass between the fixing roller 51 and the pressure roller 52 spaced apart from each other. Both the rollers 51 and 52 were rotationally driven at a surface speed (i.e., fixing speed) of 55 mm/s. The respective surface temperatures of the fixing roller 51 and the pressure roller 52 were controlled to be maintained at 175° C. By those settings, the pressing force is not applied to the toner image formed on the recording material P, and only the radiation of heat of the rollers is applied to the toner image. Thus, only the radiation of heat of the rollers is applied to the unfixed toner image, thereby making it possible to suppress dispersion of toner within the apparatus.

Embodiment 2

In this embodiment, the pressing force applied between the fixing roller 51 and the pressure roller 52 of the first fixing device a was set to 300 N, and the respective surface temperatures of both the rollers were controlled to be maintained at 50° C. Both the rollers 51 and 52 were rotationally driven at the surface speed (i.e., fixing speed) of 55 mm/s. The first fixing device a controls a cooling fan (not shown) and heating by a heater included in the rollers to regulate the surface temperatures of both the rollers to be maintained at 50° C.

Embodiment 3

In this embodiment, fixing was performed under the condition in which the pressing force applied between the fixing roller 51 and the pressure roller 52 of the first fixing device a was set to 300 N, and the respective surface temperatures of the fixing roller 51 and the pressure roller 52 were controlled to be maintained at 120° C. Both the rollers 51 and 52 were rotationally driven at the surface speed (i.e., fixing speed) of 55 mm/s.

Embodiment 4

In this embodiment, fixing was performed under the condition in which the pressing force applied between the fixing roller 51 and the pressure roller 52 of the first fixing device a was set to 300 N, and the respective surface temperatures of the fixing roller 51 and the pressure roller 52 were controlled to be maintained at 135° C. Both the rollers 51 and 52 were rotationally driven at the surface speed (i.e., fixing speed) of 55 mm/s.

Comparative Example 1

In this comparative example, fixing was performed under the condition in which the pressing force applied between the fixing roller 51 and the pressure roller 52 of the first fixing device a was set to 300 N, and the respective surface temperatures of the fixing roller 51 and the pressure roller 52 were controlled to be maintained at 155° C. Both the rollers 51 and 52 were rotationally driven at the surface speed (i.e., fixing speed) of 55 mm/s.

Comparative Example 2

In this comparative example, fixing was performed under the condition in which the pressing force applied between the fixing roller 51 and the pressure roller 52 of the first fixing device a was set to 300 N, and the respective surface temperatures of the fixing roller 51 and the pressure roller 52 were controlled to be maintained at 135° C. Both the rollers 51 and 52 were rotationally driven at the surface speed (i.e., fixing speed) of 110 mm/s.

Embodiment 5

In this embodiment, fixing was performed under the condition in which the pressing force applied between the fixing roller 51 and the pressure roller 52 of the first fixing device a was set to 300 N, and the respective surface temperatures of the fixing roller 51 and the pressure roller 52 were controlled to be maintained at 155° C. Both the rollers 51 and 52 were rotationally driven at the surface speed (i.e., fixing speed) of 110 mm/s.

Comparative Example 3

In this comparative example, fixing was performed under the condition in which the pressing force applied between the fixing roller 51 and the pressure roller 52 of the first fixing device a was set to 300 N, and the respective surface temperatures of the fixing roller 51 and the pressure roller 52 were controlled to be maintained at 175° C. Both the rollers 51 and 52 were rotationally driven at the surface speed (i.e., fixing speed) of 110 mm/s.

With respect Embodiments 1 to 5 and Comparative Examples 1 to 3, in the same manner as described above, the void ratio G(%) was obtained as follows:

$$G=100\times(t1-t2)/t1.$$

Further, the above-mentioned Embodiments 1 to 5 and Comparative Examples 1 to 3 were evaluated with respect to the following items a) to c):

a) Defective Image Due to Toner Offset

Figure 8:
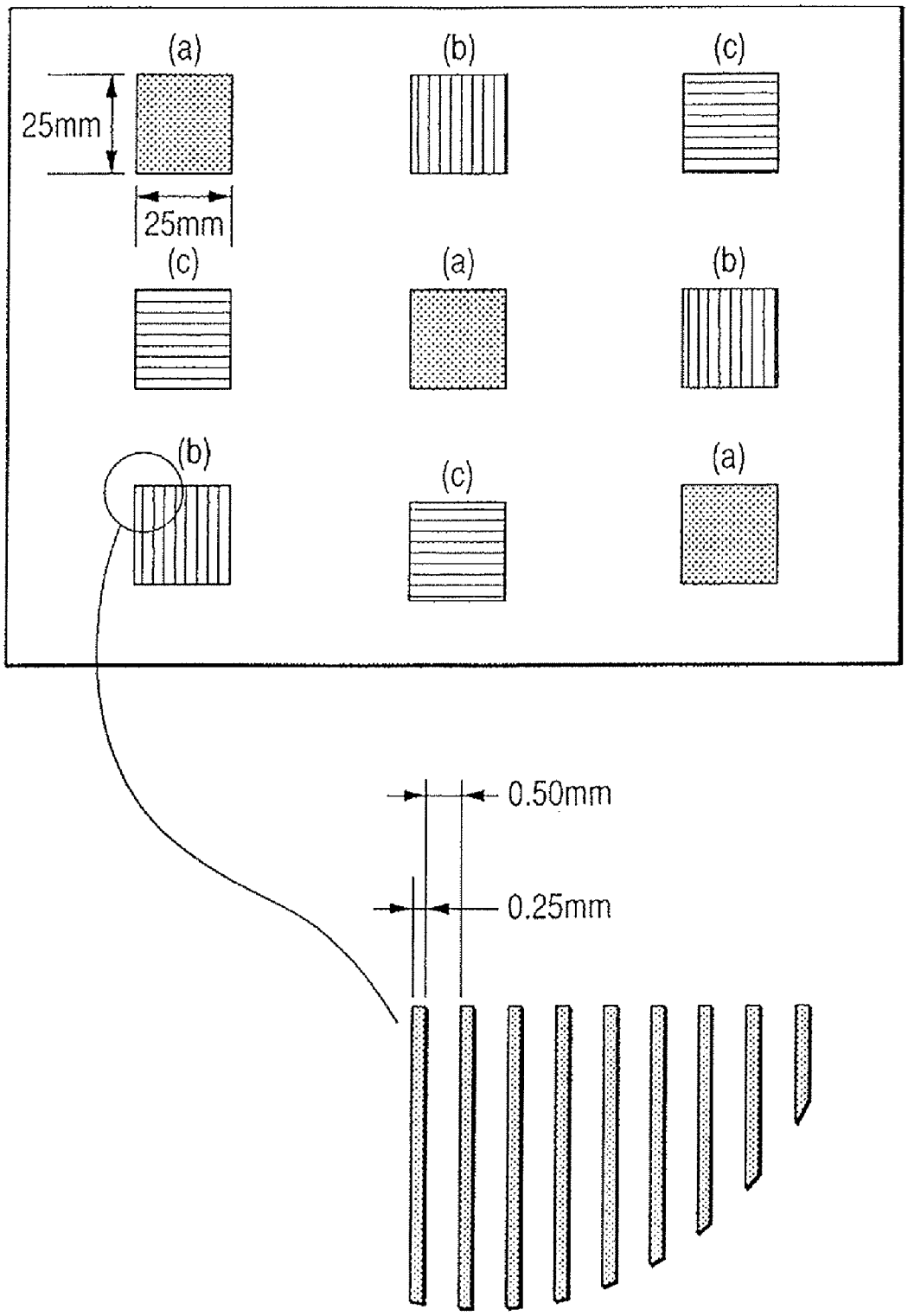
FIG. 8 is a diagram showing test patterns formed on the recording material P2 in evaluation of a defective image caused by an offset, evaluation of stain on a transport roller, and evaluation of a defect in glossiness.

As shown in FIG. 8, used as an image to be evaluated was an image having three types of images arranged on one screen, that is: solid images of a second color (i.e., blue) having a square shape of 25 mm; patch images having a square shape of 25 mm with line patterns formed on the entire surface thereof; and patch images having a square shape of 25 mm with the same line patterns rotated by 90° formed on the entire surface thereof. The line image has a pattern in which an image portion of 0.25 mm alternates with a non-image portion of 0.5 mm. The output image of the above-mentioned image to be evaluated was evaluated based on the following criteria.

Category B: Offset (i.e., defect portion) does not occur in both the solid portions and the line portions.

Category C: Offset occurs in the line portions or edge portions of the solid portions.

Category D: Offset occurs on the entire surface including both the solid portions and the line portions.

b) Stain on the Transport Roller

Stain of toner adhering to the second delivery roller pair 37 was evaluated based on the following criteria.

Category B: Little adhesion of toner can be visually observed.

Category C: Adhesion of toner can be seen, but the amount of adhesion is hardly increased.

Category D: Adhesion of toner can be seen, and the amount of adhesion is increased when printing is repeatedly performed.

c) Defect in Glossiness (Area Ratio (%))

The defect in glossiness such as the dimple S1 shown in FIG. 4D was evaluated by the area ratio. To be specific, after the above-mentioned pattern was fixed by the first and second fixing devices, the recorded surface was observed with a microscope, and then, the defect in glossiness was calculated from the area of the portion having the defect in glossiness, such as the dimple S1, and the entire area. The defect in glossiness was evaluated based on the following criteria from the calculated area.

Category A: Area ratio of the defect in glossiness is less than 10%.

Category B: Area ratio of the defect in glossiness is within a range of 10% or more to less than 20%.

Category D: Area ratio of the defect in glossiness is 20% or more.

With respect to the above-mentioned Embodiments 1 to 5 and Comparative Examples 1 to 3, main components and evaluation results of the respective examples are shown in Table 1.

TABLE 1

| | Presence/ absence of pressing force of fixing device a | Speed of fixing device a (mm/s) | Temperature of fixing device a (° C.) | Thickness of toner before fixing by fixing device b t1(μm) | Thickness of toner after fixing by fixing device b t2(μm) | Void ratio (%) G = 100 × (t1 − t2)/ t1 | Image defect due to offset | Stain on transport roller | Evaluation of defect in glossiness |
|---|---|---|---|---|---|---|---|---|---|
| Embodiment 1 | Absent | 55 | 175 | 17 | 8.3 | 51 | Category B | Category B | Category A |
| Embodiment 2 | Present | 55 | 50 | 18.6 | 7.5 | 60 | Category B | Category B | Category A |
| Embodiment 3 | Present | 55 | 120 | 14 | 8.4 | 40 | Category B | Category A | Category A |
| Embodiment 4 | Present | 55 | 135 | 11.5 | 8.5 | 26 | Category B | Category A | Category B |
| Comparative Example 1 | Present | 55 | 155 | 9.5 | 8.5 | 11 | Category B | Category A | Category D |
| Comparative Example 2 | Present | 110 | 135 | Unable to evaluate | Unable to evaluate | Unable to evaluate | Category D | Unable to evaluate | Unable to evaluate |
| Embodiment 5 | Present | 110 | 155 | 10 | 8.5 | 15 | Category C | Category A | Category B |
| Comparative Example 3 | Present | 110 | 175 | 9.4 | 8.2 | 13 | Category B | Category A | Category D |

In the Embodiments 2, 3, and 4 and Comparative Example 1, the respective surface temperatures of the fixing roller and the pressure roller of the first fixing device a are changed to 50° C., 120° C., 135° C., and 155° C., respectively. In the Comparative Example 1, the area ratio of the defect in glossiness was more than 20%. In addition, the rugged appearance of the toner in the line pattern portions was in a bad condition, and the glossiness was lower. However, by lowering the fixing temperature of the first fixing device a (as in Embodiments 4, 3, and 2 in the stated order), the area ratio was lowered and became 20% or less in Embodiment 4 in which the fixing temperature of the first fixing device a was set to 135° C. Further, in Embodiments 3 and 2, the area ratio was 10% or less, little rugged appearance of toner occurred, and an even glossy surface was obtained. Also in Embodiment 1 in which the toner image was not applied with pressure but was only heated by the first fixing device a, the even glossy surface was obtained.

FIGS. 5A to 5G are model diagrams of fixing showing a difference between Comparative Example 1 and Embodiment 3. The flow represented by FIGS. 5A, 5E, 5F, and 5G in the stated order corresponds to Embodiment 3, and the flow represented by FIGS. 5A, 5B, 5C, and 5D in the stated order corresponds to Comparative Example 1. FIG. 5A shows the unfixed state of toner, that is, states of the recording material P2 and the toner after the toner image has been transferred onto the recording material P and before the recording material P2 is introduced into the first fixing device a. The toner is present on the recording material P2 as particles, and the thickness thereof in the second color portion is about 17 μm to 20 μm.

First, in Comparative Example 1 shown in FIGS. 5B TO 5D, since the pressing force is applied to the toner image by the fixing nip portion N1 and the temperature of the fixing roller 51 is high enough, the toner is sufficiently melted, thereby decreasing the voids within the toner layer. As a result, as shown in FIG. 5B, the thickness t1 of the toner layer after the primary fixing is decreased to 9.5 μm. Few grain boundaries of toner particles are found in the toner layer, and the toner is sufficiently melted and solidified. Then, as shown in FIG. 5C, in front of the fixing nip portion N2 of the second fixing device b, the space S surrounded by the recording material P2, the fixing belt 64, and the toner layer T is present at the boundary of the toner. The space S is surrounded by the resin, so it is impossible to easily remove air from the space S. As a result, as shown in FIG. 5D, the dimple S1 is generated on the surface of the resin layer P2*a* of the recording material P2 after the secondary fixing, thereby causing the defect in glossiness. The level of glossiness of the image depends on the smoothness of each of the surface of the resin layer P2*a* of the recording material P2 and the surface of the toner image T. Thus, when the dimple S1 is generated, an uneven glossy is caused in that portion.

On the other hand, in Embodiment 3 shown in FIGS. 5E to 5G, as shown in FIG. 5E, at the time when the recording sheet passes through the first fixing device a, the toner layer is still thick and a plurality of voids remain in the toner layer. Then, as shown in FIG. 5F, in front of the fixing nip portion N2 of the second fixing device b, the space S surrounded by the recording material P2, the fixing belt 64, and the toner layer T is generated. However, the voids remain in the toner layer, so the air within the space S can be gradually removed therefrom at the time when the toner layer is melted. All the air cannot be removed from the space S depending on the state of the toner, but the uneven glossy can be reliably reduced by a certain amount. FIG. 5G is a schematic diagram showing the state of the surface of the recording material P2 after passing through the second fixing device b. As shown in FIG. 5G, the dimple S1 has a small size, and an entirely even glossy surface can be obtained.

As described above, it is assumed that the remaining amount of the toner voids contained in the toner layer on the recording material P2 which has been primarily fixed by the first fixing device a but is not yet guided into the second fixing device b is closely related to the defect in glossiness. As described above, by calculating the void ratio G in the toner layer, it has been proved that there is a correlation between the void ratio G and the area ratio of the portion having the defect in glossiness. Further, Comparative Example 2, Embodiment 5, and Comparative Example 3 in which the fixing speed of the fixing device a for each case is different from each other will be described.

In Comparative Example 2, Embodiment 5, and Comparative Example 3, the fixing speed is changed to 110 mm/s, and the correlation between the void ratio G and the area ratio of the portion having the defect in glossiness was observed. In Comparative Example 2, the fixing speed was high, but the temperature of the first fixing device a was not high enough.

Thus, the amount of heat applied to the toner by the first fixing device a is excessively insufficient, and a large amount of toner is offset to the fixing roller 51. As a result, the image after passing through the second fixing device b could not be evaluated. In Embodiment 5 and Comparative Example 3, same tendencies of the void ratio G and glossiness evaluation result were obtained as in the above-mentioned Embodiments 2, 3, and 4 and Comparative Example 1.

From the experimental results, it has been proved that the void ratio G is preferably set in a range from 15% to 60%, more preferably, from 40% to 60%. When the void ratio G is set in the range from 40% to 60%, in the recording mode B, more even recorded image can be obtained.

In Embodiments 2 and 3, an adhesion among the toner particles or an adhesion between the toner and the recording material P2 is weak, so the toner adheres to a portion of the second delivery roller pair 37 and a stain of toner appeared on the transport roller. The respective images were excellent enough since the toner gradually adheres thereto. However, in view of satisfying both high durability performance and high glossiness, the void ratio G is preferably set in a range from 15% to 40% as apparent from the experimental result.

Further, as the fixing condition of the first fixing device a, even when the void ratio G is set to the same level, in view of the toner-offset, it is preferable to employ a structure in which the same condition of melting toner in the toner layer is adopted, and a lower process speed (in this embodiment, about 55 mm/s) at which a sufficient heating time is secured is adopted.

From the above-mentioned experimental results, as the setting of the first fixing device a in the recording mode B, in a case where the fixing roller 51 is brought into contact with the toner image, the pressuring time $\tau$1 is preferably set in a range from 0.03 sec to 0.3 sec, more preferably, in a range from 0.05 sec to 0.25 sec. Each temperature of the fixing roller 51 and the pressure roller 52 is preferably set in a high temperature range from 110° C. to 160° C. or in a low temperature range from 20° C. to 60° C.

Herein, the pressuring time $\tau$1 (s) is calculated from the fixing nip width N1 (mm)/process speed (mm/s). The fixing nip width N1 (mm) is obtained in the following manner. That is, the recording material having the image formed thereon is inserted into the first fixing device a, and the drive of the motor is stopped for about 10 sec during sheet transportation to measure the variation width of the glossiness on the recorded image taken out by driving the motor again, thereby obtaining the fixing nip width N1. From the width N1, the pressuring time $\tau$1 is calculated.

In addition, when the fixing roller 51 is not directly brought into contact with the toner image (i.e., only heating by radiation of heat), the heating time is preferably set in a range from 0.2 sec to 10 sec. Further, each temperature of the fixing roller 51 and the pressure roller 52 of the first fixing device a is preferably set in a range from 100° C. to 200° C., more preferably, in a range from 150° C. to 200° C.

Second Embodiment Mode

Figure 6:
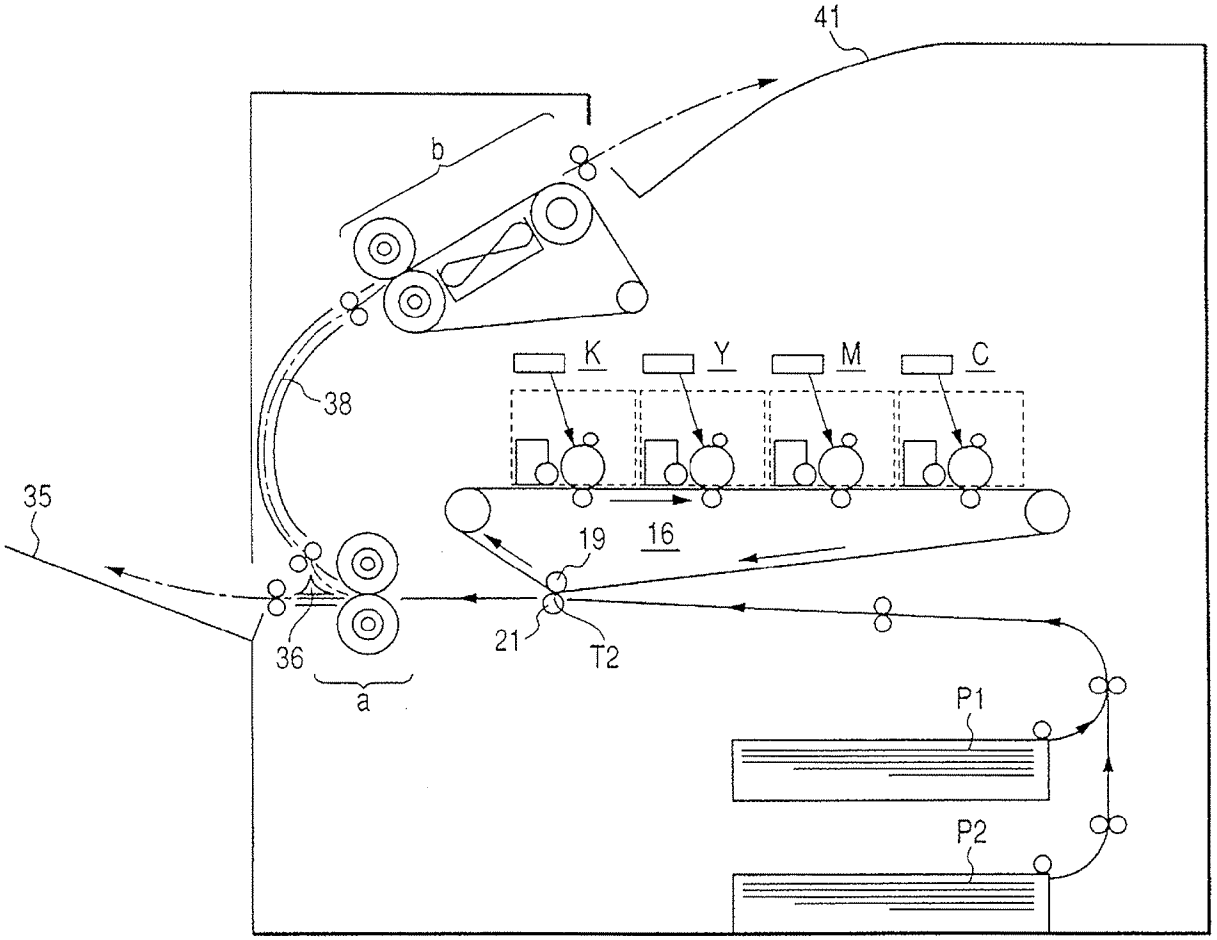
FIG. 6 is a schematic structural view of an image forming apparatus according to a second embodiment mode of the present invention.

In this embodiment mode, arrangement of the second fixing device b is largely different from that of the first embodiment mode. FIG. 6 shows a schematic view of the second device b. In the first embodiment mode, the first to fourth image forming portions, the first fixing device a, and the second fixing device b are substantially linearly aligned, and the recording material P2 is horizontally moved to be outputted in the recording mode B.

On the other hand, in this embodiment mode, in the recording mode B, the recording material P2 is introduced by being guided upward from the first fixing device a to the second fixing device b through the curved transport path 38 with a certain curvature. Further, the recording material P1 is arranged such that the recording surface thereof faces the center of the curvature by setting a curvature direction to substantially one direction. In other words, in the recording mode B, a posture of the recording material P2 after being outputted from the first fixing device a is set such that the recording material P2 is delivered and transported with the recording surface facing the inside (i.e., facing toward the center) with a certain curvature.

Embodiment 6

This embodiment is performed similarly to the second embodiment mode, and the condition of the first fixing device a of this embodiment is similar to that of Embodiment 3. An evaluation result in this embodiment was the same as in Embodiment 3, and an excellent image recording was possible. Further, in Embodiment 3, a stain of toner appeared on an inner surface of a passage of the recording material transport path 38 through which paper passes. In addition, when the toner image formed on the recording material P2 was observed, a stripe defective image appeared in the transport direction although low in frequency. However, in this embodiment, those stains and defective images were generated in a relatively low amount unlike other embodiment modes. In the first embodiment mode, since the first fixing device a and the second fixing device b are respectively fixed to separate housings, it is assumed that the structures thereof are disadvantageous in view of the accuracy of a position of a paper passing path. Also with regard to the transport path 38 between the first fixing device a and the second fixing device b, it is assumed that the second embodiment mode, in which a distance between the transport path and the recording surface can be reliably maintained with the recording surface of the recording material P2 facing inside, is more advantageous than the first embodiment mode in which the transport path 38 is arranged to be substantially straight. In other words, with the above-mentioned structure, it is possible to transport the recording material P2 from the first fixing device a to the second fixing device b without disturbing the recording surface having a low fix level or without staining the transport path both of which have negative effects in the recording mode B.

As described above, it is possible to secure the fixing performance of a paper medium with a wide width, and perform recording of a color-image having excellent glossiness by the use of the glossy dedicated paper. In particular, the fixing condition for the first fixing device a as the primary fixation using a dedicated paper having a resin layer is set within a range of a predetermined void ratio, thereby making it possible to obtain the photo-like favorable toner image having a high gloss.

This application claims priority from Japanese Patent Application No. 2005-239771 filed on Aug. 22, 2005 and Japanese Patent Application No. 2006-216793 filed on Aug. 9, 2006, and a part of this application is cited from contents thereof.

What is claimed is:

1. An image forming apparatus, comprising:

an image forming portion for forming a toner image on a recording material;

a fixing device for performing a heating process on the toner image formed on the recording material in the image forming portion; and a glossiness applying device provided to a downstream side of the fixing device in a moving direction of the recording material, the glossiness applying device including an endless belt contacted with the toner image formed on the recording material and a pressure roller forming a nip portion for pinching the recording material by being in contact with an outer peripheral surface of the endless belt, for performing a heating process on the toner image formed on the recording material and then cooling the toner image in a state where the recording material is brought into contact with the endless belt, wherein the image forming apparatus includes a first recording mode in which the recording material is outputted without being subjected to a glossing process by the glossiness applying device after the toner image is subjected to the heating process by the fixing device; and a second recording mode in which the glossing process is performed on the toner image by the glossiness applying device after the toner image is subjected to the heating process by the fixing device, and then the recording material is outputted, wherein in the second recording mode, the image forming apparatus forms a toner image on a surface of a recording material having a thermoplastic resin layer and the glossiness applying device embeds the toner image on the surface of the recording material in the thermoplastic resin layer of the recording material, and wherein in a case where a void ratio G of toner in the toner image formed on the recording material, which has been subjected to the heating process by the fixing device and has not yet been subjected to the glossing process by the glossiness applying device, is defined by a thickness t1 (μm) of a toner layer formed on the recording material before entering the glossiness applying device passing through the fixing device, and a thickness t2 (μm) of a toner layer formed on the recording material after passing through the glossiness applying device, as follows:

$$G=100\times(t1-t2)/t1,$$

in the second recording mode, the fixing device and the glossiness applying device are respectively set so that the void ratio G (%) of toner satisfies a formula $15 \leqq G \leqq 60$.

2. An image forming apparatus according to claim 1, wherein, in the second recording mode, the fixing device and the glossiness applying device are respectively set so that the void ratio G (%) of toner satisfies a formula $40 \leqq G \leqq 60$.

3. An image forming apparatus according to claim 1, wherein, in the second recording mode, the toner image formed on the recording material is applied with pressure by the fixing device, a time for heating the toner image by the fixing device in the second recording mode is set in a range from 0.03 sec to 0.3 sec, a preset temperature of the fixing device is set in one of a range from 110° C. to 160° C. and a range from 20° C. to 60° C., a time for heating the toner image by the glossiness applying device is set in a range from 0.05 sec to 0.25 sec, and a preset temperature of the glossiness applying device is set in a range from 100° C. to 200° C.

4. An image forming apparatus according to claim 1, wherein, in the second recording mode, the toner image formed on the recording material is free from being applied with pressure by the fixing device, a time for heating the toner image by the fixing device in the second recording mode is set in a range from 0.2 sec to 10 sec, a preset temperature of the fixing device is set in a range from 100° C. to 200° C., a time for heating the toner image by the glossiness applying device is set in a range from 0.05 sec to 0.25 sec, and a preset temperature of the glossiness applying device is set in a range from 100° C. to 200° C.

5. An image forming method of forming a toner image on a recording material having a thermoplastic resin layer on a surface of the recording material, comprising:

a step of forming a toner image on the thermoplastic resin layer of the recording material, a step of heating the toner image on the recording material, a step of applying glossiness to reheat the toner image on the recording material after the step of heating the toner image in a condition where the toner image on the recording material contacts an endless belt, and tp cool the toner image, and wherein in a case where a void ratio G of toner in the toner image formed on the recording material, which has been subjected to the step of heating the toner image and has not yet been subjected to the step of applying a glossiness, is defined by a thickness t1 (μm) of a toner layer formed on the recording material before entering the step of applying the glossiness but after the step of heating the toner image, and a thickness t2 (μm) of a toner layer formed on the recording material after passing through the step of applying glossiness, as follows:

$$G=100\times(t1-t2)/t1,$$

and the void ratio G (%) of toner satisfies a range of $15 \leqq G \leqq 60$.

* * * * *